US007137695B2

(12) United States Patent
Yokoyama

(10) Patent No.: US 7,137,695 B2
(45) Date of Patent: Nov. 21, 2006

(54) INKJET RECORDING APPARATUS

(75) Inventor: Takeshi Yokoyama, Machida (JP)

(73) Assignee: Konica Minolta Medical & Graphics, Inc., Tokyo (JP)

( * ) Notice: Subject to any disclaimer, the term of this patent is extended or adjusted under 35 U.S.C. 154(b) by 240 days.

(21) Appl. No.: 10/946,952

(22) Filed: Sep. 21, 2004

(65) Prior Publication Data

US 2005/0068397 A1 Mar. 31, 2005

(30) Foreign Application Priority Data

Sep. 30, 2003 (JP) ..... 2003-339354

(51) Int. Cl.
*B41J 2/01* (2006.01)

(52) U.S. Cl. ..... 347/102; 347/101

(58) Field of Classification Search ..... 347/102, 347/101

See application file for complete search history.

(56) References Cited

U.S. PATENT DOCUMENTS 3,983,039 A * 9/1976 Eastland ..... 250/492.1
4,025,795 A * 5/1977 Lackore et al. ..... 250/504 R
4,177,383 A * 12/1979 Knight ..... 250/492.1
4,222,177 A * 9/1980 Mason ..... 34/278
4,303,924 A 12/1981 Young, Jr. ..... 346/1.1
4,434,562 A * 3/1984 Bubley et al. ..... 34/278
4,644,899 A * 2/1987 Glaus ..... 118/642
5,722,761 A * 3/1998 Knight ..... 362/96
6,164,757 A 12/2000 Wen et al. ..... 347/43
6,543,890 B1 4/2003 Ylitalo et al. ..... 347/102
6,621,087 B1 * 9/2003 Bisges et al. ..... 250/492.1
6,739,716 B1 * 5/2004 Richards ..... 347/102
2002/0101491 A1 8/2002 Ervin et al. ..... 347/102
2003/0011669 A1 * 1/2003 Tsuboi et al. ..... 347/102
2003/0184631 A1 * 10/2003 Suzuki et al. ..... 347/102

OTHER PUBLICATIONS

European Search Report for EP004104682.2, mailed Jan. 19, 2005, 4 pgs.

* cited by examiner

*Primary Examiner*—Stephen Meier
*Assistant Examiner*—Leonard Liang
(74) *Attorney, Agent, or Firm*—Squire, Sanders & Dempsey L.L.P.

(57) ABSTRACT

An inkjet recording apparatus, including:

a recording head for jetting ultraviolet ray curable ink onto a recording medium;

an ultraviolet ray emitting device;

a light source which emits ultraviolet rays;

a first reflecting section for reflecting the ultraviolet rays; and a second reflecting section which is installed within the first reflecting section at an angle for preventing the ultraviolet rays from approaching the ultraviolet ray curable ink in the recording head, and behind the second reflecting section, a space for trapping stray ultraviolet rays diffused from the recording medium is formed.

12 Claims, 5 Drawing Sheets

INKJET RECORDING APPARATUS

FIELD OF THE INVENTION

The present invention relates to an inkjet recording apparatus, and in particular, to an inkjet recording apparatus wherein the carriage and the overall apparatus can be downsized, and wherein the amount of ultraviolet rays which reach a nozzle surface area of the recording head from a light source, disposed adjacent to the recording head, is reduced as much as possible.

BACKGROUND OF THE INVENTION

In recent years, as an apparatus which forms an image on a paper sheet, a resin film and fabric, by using ink, a light emission type inkjet recording apparatus is in heavy usage, wherein the ink is jetted from a nozzle of a recording head, and the deposited ink is hardened by emitted light from a light emission means, resulting in a fixed image. The inkjet recording apparatus is characterized in that it can form the image on a recording medium having the low absorbability of ink. Concerning the ink, mainly used is ultraviolet ray curable ink which is readily hardened by ultraviolet ray radiation (see Patent Document 1).

On the inkjet recording apparatus, since ink has a fluid nature, while the ink deposited on the recording medium is hardened and fixed by the ultraviolet ray radiation, the diameter of the ink dots increases, and the ink dots seep out each other, or the ink penetrates the recording medium, resulting in the change of image quality. That is, after ink deposition, the increase of the ink dot diameter and seeping into the recording medium become significant, therefore, it is preferable that the interval between ink-jetting and the light radiation is shortened as much as possible. For a generally used method, the light source is disposed as close as possible to the recording head (see Patent Document 2).

Patent Document 1: U.S. Pat. No. 6,145,979

Patent Document 2: Japanese Tokkaisyo 60-132767

However, when the nozzle of the recording head is as adjacent to the light source as described above, the ultraviolet rays emitted from the light source are diffusely reflected and tend to reach the nozzle, after which the ink near a nozzle mouth starts a polymeric reaction, resulting in an increase of the ink viscosity or hardened ink.

Strictly explaining the above described diffusing reflection, when the ultraviolet rays are emitted from the light source and reach the recording medium, the ultraviolet rays are scattered due to the reflection, resulting in mixed and scattered rays, wherein the complete diffuse reflection which generates the reflected light rays of various exit angles, and nearly regular reflection which generates scattered energy distribution centering on the regular reflection light, are mixed. In general, the scattered ultraviolet rays have the maximum scattered energy in the same direction as the regular reflection of the incident rays, and the more the angle increases from the regular reflection direction, the smaller the resulting scattered energy.

That is, the ultraviolet rays diverge from the light source, and when the recording head is adjacent to the light source, the ultraviolet rays traveling directly to the recording head, as well as the ultraviolet rays reflected by a reflector and traveling to the recording head, being stray ultraviolet rays, are reflected and scattered by the recording medium, and then stray ultraviolet rays reach the nozzle of the recording head.

In this case, as the ultraviolet rays reach the nozzle of the recording head, any ink near the nozzle mouse causes a compound reaction, resulting in an increase viscosity or hardening of the ink, which generates the trouble of ink jetting, whereby ink depositing accuracy is decreased, and highly precise images are rarely formed, which is problematic.

In recent years, serial type inkjet recording apparatuses incorporate an ultraviolet ray emitting device on the carriage carrying the recording head, and resulting in the tendency for the carriage to become relatively large, since it incorporates various members, such as a sub-ink tank, and its downsizing is demanded. In order to overcome the above problems, the distance between the recording head on the carriage and the ultraviolet ray emitting device has been increased, or a light trap is installed more between them, which result in a still larger size of the carriage, which does not answer downsizing. Further in the case of a line method inkjet recording apparatus, if the distance between the recording head and the ultraviolet ray emitting device is increased, and a light trap is installed at said distance, the apparatus becomes excessively large, which of course also does not result in downsizing.

SUMMARY OF THE INVENTION

The objective of the present invention is to provide an inkjet recording apparatus, wherein the carriage or said apparatus can be downsized, and further, by reducing the amount of stray ultraviolet rays to the utmost, which are emitted from the light source, disposed adjacent to the recording head, and reach the surface (hereinafter referred to as a nozzle surface area) on which the nozzle of recording head is disposed, and thereby the ink is stably jetted over a long term, and the inkjet recording apparatus can form images having a high ink droplet depositing accuracy.

By attaining any one of the structures described below, the above problems will be overcome.

Structure 1

An inkjet recording apparatus, wherein ultraviolet curable ink is jetted from a recording head onto a recording medium, after which ultraviolet rays are emitted from an ultraviolet ray emitting device, onto the ultraviolet curable ink deposited on the recording medium, to fix the inked image, the ultraviolet ray emitting device incorporates a light source, and a first reflecting section for reflecting the ultraviolet rays, emitted from the light source, onto the recording medium, wherein within a space of the first reflecting section and at the recording head side, a second reflecting section is installed at an angle in such a manner that the closer the second reflecting section is to the recording medium, the farther the second reflecting section gets away from the recording head, and thereby the space behind the second reflecting section, being next to the recording head, serves as an ultraviolet ray trapping space.

Based on Structure 1, the second reflecting section blocks the ultraviolet rays, emitted from the light source of the ultraviolet ray emitting device, or alternatively the ultraviolet ray trapping space formed behind the second reflecting section, absorbs any stray ultraviolet rays, and thereby the second reflecting section effectively blocks leakage of the ultraviolet rays toward the recording head.

Structure 2

The inkjet recording apparatus described in Structure 1, wherein the first reflecting section reflects the ultraviolet rays emitted from the light source, and concentrates them onto the recording medium.

Based on Structure 2, the ultraviolet rays emitted from the light source are concentrated onto the recording medium, and thereby concentrated and strong ultraviolet rays are radiated onto the ink, just after it has been deposited, additionally, the second reflecting section does not block the ultraviolet rays traveling to the recording medium.

Structure 3

The inkjet recording apparatus described in Structure 2, wherein distance "a", which is between the focal point of the ultraviolet rays reflected by the first reflecting section onto the recording medium and a position of the ultraviolet ray curable ink deposited onto the recording medium, is greater than distance "b", which is between a foot which is dropped perpendicularly from the light source to the recording medium and the position of the ultraviolet ray curable ink deposited onto the recording medium.

Based on Structure 3, the ultraviolet rays concentrated by the first reflecting section are reflected to the area farther than the recording head, and thereby stray ultraviolet rays toward the recording head are effectively reduced.

Structure 4

The inkjet recording apparatus described in Structure 1, wherein the first reflecting section reflects the ultraviolet rays emitted from the light source, to be parallel to each other, and said parallel rays are radiated onto the recording medium.

Based on Structure 4, even when the first reflecting section is composed to make parallel ultraviolet rays via reflection, since the second reflecting section, disposed within a space of the first reflecting section, is inclined from the recording head, the parallel ultraviolet rays are reflected by the second reflecting section to a point farther away from the nozzle surface area of the recording head. Additionally, the ultraviolet rays are effectively absorbed by the ultraviolet ray trapping space formed behind the second reflecting section.

Structure 5

The inkjet recording apparatus described in Structure 2 or 3, wherein the second reflecting section is formed in such a manner that the top, adjacent to the recording medium, of the second reflecting section does not block the concentrated rays which are reflected by the first reflecting section and travel to a focal point on the recording medium.

Based on structure 5, the second reflecting section does not block the concentrated ultraviolet rays, and thereby the ultraviolet rays, emitted from the light source, reflected and concentrated by the first reflecting section, are properly radiated to the recording medium.

Structure 6

The inkjet recording apparatus described in Structure 1, wherein ultraviolet ray absorbing material for absorbing the ultraviolet rays, is coated on an interior surface of the ultraviolet ray trapping space.

Based on structure 6, the ultraviolet ray absorbing material, coated on the interior surface of the ultraviolet ray trapping space, effectively absorbs any stray ultraviolet rays reaching the ultraviolet ray trapping space.

Structure 7

The inkjet recording apparatus described in Structure 1, wherein a rear surface of the second reflecting section, being one of the interior surfaces of the ultraviolet ray trapping space, is coated with material for absorbing the ultraviolet rays.

Based on Structure 7, the rear surface of the second reflecting section, being one of the interior surfaces of the ultraviolet ray trapping space, is coated with material for absorbing the ultraviolet rays, and thereby any stray ultraviolet rays reaching the ultraviolet ray trapping space are effectively absorbed.

Structure 8

The inkjet recording apparatus described in Structure 1, wherein the material for absorbing the ultraviolet rays is coated on an interior surface of a box structuring the ultraviolet ray emitting device.

Based on structure 8, the ultraviolet ray absorbing material is coated on the interior surface of the box structuring ultraviolet ray emitting device, and thereby the ultraviolet rays, reached the ultraviolet ray trapping space, can be effectively absorbed, and further, any stray ultraviolet rays are absorbed so that the ultraviolet rays do not penetrate the light source box.

Structure 9

The inkjet recording apparatus described in Structure 1, wherein the light source is a single light source.

Based on structure 9, the light source of ultraviolet emitting device is a single light source, and thereby, the radiated light rays are concentrated onto a single point, by which focusing by the first reflecting section and blocking by the second reflecting section of the ultraviolet rays are effectively accomplished.

Structure 10

The inkjet recording apparatus described in Structure 9, wherein the light source is any one of a high-pressure mercury lamp, a metal halide lamp, a black light, a cold cathode lamp, and an LED.

Based on structure 10, the high-pressure mercury lamp, metal halide lamp, black light, cold cathode lamp, or LED, is used for the light source, and even though it is a single light source, the required amount of ultraviolet rays can be radiated onto the recording medium.

Structure 11

The inkjet recording apparatus described in structure 1, wherein the recording head employs a serial method or a line method.

Based on Structure 11, the function and effect of the present invention are exerted on the serial method ink-jet recording apparatus, as well as on the line method recording apparatus.

Structure 12

The inkjet recording apparatus described in structure 1, wherein the ultraviolet ray curable ink is a cation polymerizable system ink.

Based on structure 12, the ultraviolet rays emitted from the light source of the ultraviolet ray emitting device are perfectly blocked from leaking toward the recording head. When cation polymerizable ink, characterizing in that the polymerization reaction proceeds based on the amount of radiated ultraviolet rays, is used for the inkjet recording apparatus, it prevents cation polymerizable ink from absorbing the ultraviolet rays near the nozzle mouth of the nozzle surface area of the recording head. Therefore, cation polymerizable ink does not increase viscosity nor is it hardened.

Structure 13

An inkjet recording apparatus, including:

a recording head for jetting ultraviolet ray curable inks onto a recording medium, an ultraviolet ray emitting device, for emitting ultraviolet rays onto the ultraviolet ray curable inks deposited on the recording medium, and for hardening and fixing the ultraviolet ray curable inks, including a light source which emits ultraviolet rays, and a first reflecting section for reflecting the ultraviolet rays, emitted from the light source, onto the recording medium, wherein distance "a", which is between a focal point of the ultraviolet rays reflected by the first reflecting section onto the recording medium and a position of the ultraviolet ray curable ink deposited onto the recording medium, is greater than distance "b", which is between a foot which is dropped perpendicularly from the light source to the recording medium and the position of the ultraviolet ray curable ink deposited onto the recording medium.

Based on Structure 13, the ultraviolet rays concentrated by the first reflecting section are directed to the area farther than the recording head, and thereby stray ultraviolet rays toward the recording head are effectively reduced.

Structure 14

The inkjet recording apparatus described in Structure 13, wherein the material for absorbing the ultraviolet rays is coated on an interior surface of a box structuring the ultraviolet ray emitting device.

Based on Structure 14, the ultraviolet ray absorbing material is coated on the interior surface of the box structuring ultraviolet ray emitting device, and thereby the stray ultraviolet rays can be effectively absorbed, so that the ultraviolet rays do not penetrate the light source box.

Structure 15

The inkjet recording apparatus described in Structure 13, wherein the light source is a single light source.

Based on structure 15, the light source of ultraviolet emitting device is a single light source, and thereby, the emitted light rays are concentrated onto a single point, by which focusing by the first reflecting section is effectively accomplished.

Structure 16

The inkjet recording apparatus described in Structure 15, wherein the light source is any one of a high-pressure mercury lamp, a metal halide lamp, a black light, a cold cathode lamp, and an LED.

Based on structure 16, the high-pressure mercury lamp, metal halide lamp, black light, cold cathode lamp, or LED, is used for the light source, and even though it is a single light source, the required amount of ultraviolet rays can be radiated onto the recording medium.

Structure 17

The inkjet recording apparatus described in structure 13, wherein the recording head employs a serial method or a line method.

Based on Structure 17, the function and effect of the present invention are exerted on the serial method ink-jet recording apparatus, as well as on the line method recording apparatus.

Structure 18

The inkjet recording apparatus described in structure 13, wherein the ultraviolet ray curable ink is a cation polymerizable system ink.

Based on structure 18, the ultraviolet rays emitted from the light source of the ultraviolet ray emitting device are perfectly blocked from leaking toward the recording head. When cation polymerizable ink, characterizing in that the polymerization reaction proceeds based on the amount of radiated ultraviolet rays, is used for the inkjet recording apparatus, it prevents cation polymerizable ink from absorbing the ultraviolet rays near the nozzle mouth of the nozzle surface area of the recording head. Therefore, cation polymerizable ink does not increase viscosity nor is it hardened.

The effects of this invention will be described below.

Based on structure 1, since the second reflecting section is employed, the ultraviolet rays emitted from the light source of the ultraviolet ray emitting device are blocked by the second reflecting section, or absorbed by the ultraviolet ray trapping space formed by the side emitting plate, and thereby leakage of the ultraviolet rays toward the recording head are effectively blocked by the second reflecting section. Further, prevented are stray ultraviolet rays leaking toward the recording head, which the ink near the nozzle mouth of the nozzle surface area of the recording head would absorb. Therefore, this structure positively prevents an increase in ink viscosity and ever hardening, by which the ink can be stably jetted from the recording head over an extended period of time, and the inkjet recording apparatus can form images with high ink droplet depositing accuracy. Further, since the second reflecting section is employed within the space of the first reflecting section of the ultraviolet ray emitting device, the ultraviolet ray trapping space can be formed without making an additional ultraviolet ray trapping space, that is, without increasing the clearance between the recording head and the ultraviolet ray emitting device, so that the carriage can be downsized, specifically in the case of the serial method ink-jet recording apparatus.

Based on Structure 2, the ultraviolet rays, emitted from the light source, are concentrated on the recording medium, and since the concentrated and strong ultraviolet rays are radiated onto the ink just after deposition, and additionally, through the second reflecting section being employed, the loss of the ultraviolet rays can be effectively controlled. That is, the full amount of ultraviolet rays reach the ink deposited on the recording medium, which harden and fix the ink, so that extremely precise image formation can be achieved.

Based on structure 3, since the ultraviolet rays, concentrated by the first reflecting section, are reflected to a point farther than the recording head, leakage of the ultraviolet rays toward the recording head are effectively blocked. Further, it prevents ink from absorbing any stray ultraviolet rays near the nozzle mouth of the nozzle surface area of the recording head, and as a result, it prevents an increase in ink viscosity or ever hardening. Due to this, stable ink jetting from the recording head is possible over an extended period of time, and image formation at high ink depositing accuracy can be achieved.

Based on structure 4, since parallel ultraviolet rays are reflected due to the second reflecting section, to a point farther away from the nozzle surface area of the recording head, and since the ultraviolet rays are effectively trapped by the ultraviolet ray trapping space formed behind the second reflecting section, it prevents ink from absorbing stray ultraviolet rays near the nozzle mouth of the nozzle surface area of the recording head, and as a result, it prevents an increase in ink viscosity or ever hardening. Due to this, stable ink jetting from the recording head is possible over an extended period of time, and image formation at high depositing accuracy can be achieved.

Based on structure 5, since the second reflecting section does not block the concentrated ultraviolet rays, and since the ultraviolet rays, emitted from the light source, and reflected by the first reflecting section, are concentrated and assuredly radiated onto the recording medium, whereby the ink deposited on the recording medium is hardened and fixed. Due to this, precise image formation is attainable.

Based on structure 6, since the ultraviolet ray absorbing material, coated on the interior surface of the ultraviolet ray trapping space, effectively absorbs any stray ultraviolet rays reaching the ultraviolet ray trapping space, leakage of ultraviolet rays toward the recording head is blocked, and thereby it prevents that the ink absorbs any ultraviolet rays near the nozzle mouth of the nozzle surface area of the recording head, and as a result, it prevents any increase in ink viscosity and unintended hardening. Due to this, stable ink jetting from the recording head is possible over an extended period of time, and image formation at high depositing accuracy can be achieved.

Based on structure 7, since the ultraviolet ray absorbing material is coated at least on the rear surface of the second reflecting section, among the interior surfaces of the ultraviolet ray trapping space, any stray ultraviolet rays, reaching the ultraviolet ray trapping space, are effectively absorbed. Further, leakage of the ultraviolet rays toward the recording head is blocked, and thereby it prevents the ink from absorbing stray ultraviolet rays near the nozzle mouth of the nozzle surface area of the recording head, and as a result it prevents any increase in ink viscosity and unintended hardening. Due to this, stable ink jetting from the recording head is possible over an extended period of time, and image formation at high depositing accuracy can be achieved.

Based on structure 8, since the ultraviolet ray absorbing material is coated on the interior surface of the box structuring the ultraviolet ray emitting device, any stray ultraviolet rays reaching the ultraviolet ray trapping space can be effectively absorbed, and further, the stray ultraviolet rays are blocked so that the ultraviolet rays cannot penetrate the light source box. Additionally, it prevents injury to the human body and damage to the apparatus itself by the harmful ultraviolet rays.

Based on structure 9, since the light source of ultraviolet emitting device is a single light source, and focusing by the first reflecting section as well as blocking by the second reflecting section of the ultraviolet rays are effective, it prevents the ink from absorbing the ultraviolet rays near the nozzle mouth of the nozzle surface area of the recording head, and as a result, it prevents any increase in the ink viscosity and is unintended hardening. Due to this, stable ink jetting from the recording head is possible over an extended period of time, and image formation at high depositing accuracy can be achieved.

Based on structure 10, since a high-pressure mercury lamp, metal halide lamp, black light, cold cathode lamp, or LED, may be used for the light source, focusing by the first reflecting section as well as blocking by the second reflecting section of the ultraviolet rays are effective, and thereby leakage of stray ultraviolet rays toward the recording head is prevented, and further, it prevents the ink from absorbing the ultraviolet rays near the nozzle mouth of the nozzle surface area of the recording head, and as a result, it prevents any increases in the ink viscosity and unintended hardening. Due to this, stable ink jetting from the recording head is possible over an extended period of time, and image formation at high depositing accuracy can be achieved.

Based on structure 11, since the function and effect unique to the present invention are exerted on the serial method inkjet recording apparatus, as well as the line method recording apparatus, leakage of stray ultraviolet rays toward the recording head is prevented, and further, it prevents any ink from absorbing stray ultraviolet rays near the nozzle mouth of the nozzle surface area of the recording head, and as a result, it prevents any increase in the ink viscosity and unintended hardening. Due to this, stable ink jetting from the recording head is possible over an extended period of time, and image formation at high droplet depositing accuracy can be achieved. Additionally, since the second reflecting section is employed within the first reflecting section of the ultraviolet ray emitting device, even in the line method ink-jet recording apparatus, the ultraviolet ray trapping space can be formed without an additional ultraviolet ray trapping space, through increasing the clearance between the recording head and the ultraviolet ray emitting device, by which means the apparatus can be downsized.

Based on structure 12, when cation polymerizable ink is used for the inkjet recording apparatus, it prevents cation polymerizable ink from absorbing any stray ultraviolet rays near the nozzle mouth of the nozzle surface area of the recording head, and as a result, it prevents any increase in the cation polymerizable ink viscosity and unintended hardening. Due to this, stable ink jetting from the recording head is possible over an extended period of time, and image formation at high droplet depositing accuracy can be achieved. Further, these advantages are effectively utilized in that the polymerization reaction of cation polymerizable ink is not interrupted by oxygen in the ambient air.

Based on structure 13, since the ultraviolet rays, concentrated by the first reflecting section, are reflected to an area farther than the recording head, leakage of the ultraviolet rays toward the recording head are effectively reduced. Further, it prevents ink from absorbing any stray ultraviolet rays near the nozzle mouth of the nozzle surface area of the recording head, and as a result, it prevents an increase in ink viscosity or ever hardening in the nozzle mouth. Due to this, stable ink jetting from the recording head is possible over an extended period of time, and image formation at high ink depositing accuracy can be achieved.

Based on structure 14, since the ultraviolet ray absorbing material is coated on the interior surface of the light source box, the stray ultraviolet rays are blocked so that the ultraviolet rays cannot penetrate the light source box. Additionally, it prevents injury to the human body and damage to the apparatus itself by the harmful ultraviolet rays.

Based on structure 15, since the light source of ultraviolet emitting device is a single light source, and focusing by the first reflecting section is effective, it prevents the ink from absorbing the ultraviolet rays near the nozzle mouth of the nozzle surface area of the recording head, and as a result, it prevents any increase in the ink viscosity and is unintended hardening. Due to this, stable ink jetting from the recording head is possible over an extended period of time, and image formation at high depositing accuracy can be achieved.

Based on structure 16, since a high-pressure mercury lamp, metal halide lamp, black light, cold cathode lamp, or LED, may be used for the light source, and focusing by the first reflecting section is effective, and thereby leakage of stray ultraviolet rays toward the recording head is prevented, and further, it prevents the ink from absorbing the ultraviolet rays near the nozzle mouth of the nozzle surface area of the recording head, and as a result, it prevents any increases in the ink viscosity and unintended hardening. Due to this, stable ink jetting from the recording head is possible over an extended period of time, and image formation at high depositing accuracy can be achieved.

Based on structure 17, since the function and effect unique to the present invention are exerted on the serial method inkjet recording apparatus, as well as on the line method recording apparatus, leakage of stray ultraviolet rays toward the recording head is prevented, and further, it prevents any ink from absorbing stray ultraviolet rays near the nozzle mouth of the nozzle surface area of the recording head, and as a result, it prevents any increase in the ink viscosity and unintended hardening. Due to this, stable ink jetting from the recording head is possible over an extended period of time, and image formation at high droplet depositing accuracy can be achieved.

Based on Structure 18, when cation polymerizable ink is used for the inkjet recording apparatus, it prevents cation polymerizable ink from absorbing any stray ultraviolet rays near the nozzle mouth of the nozzle surface area of the recording head, and as a result, it prevents any increase in the cation polymerizable ink viscosity and unintended hardening. Due to this, stable ink jetting from the recording head is possible over an extended period of time, and image formation at high droplet depositing accuracy can be achieved. Further, these advantages are effectively utilized in that the polymerization reaction of cation polymerizable ink is not interrupted by oxygen in the ambient air.

DETAILED DESCRIPTION OF THE PREFERRED EMBODIMENT

Figure 1:
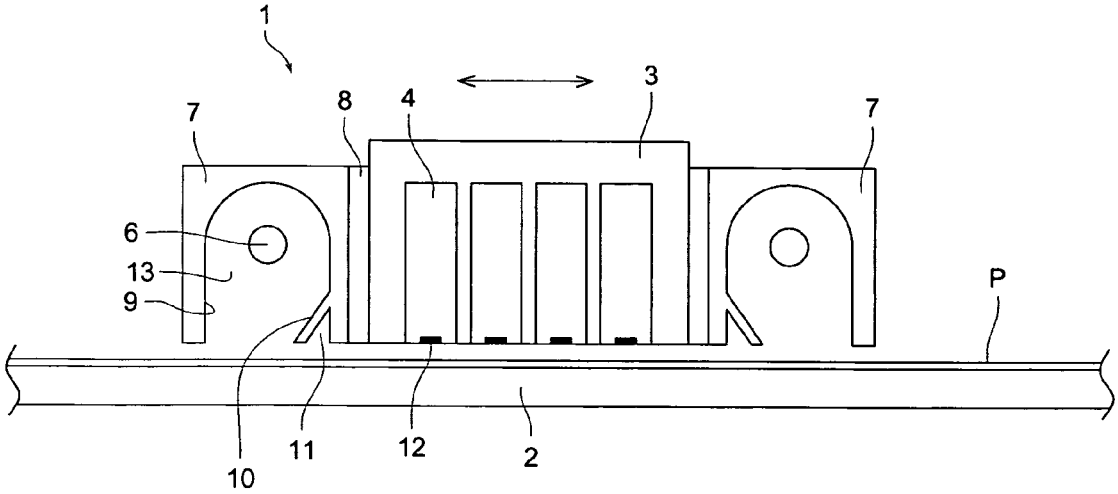
FIG. 1 is a schematic drawing of a carriage and an ultraviolet ray emitting device of a serial method inkjet recording apparatus of the present embodiment.

The embodiments relating to the inkjet recording apparatus of the present invention will now be described below, while referring to the drawings.

[The First Embodiment]

Figure 2:
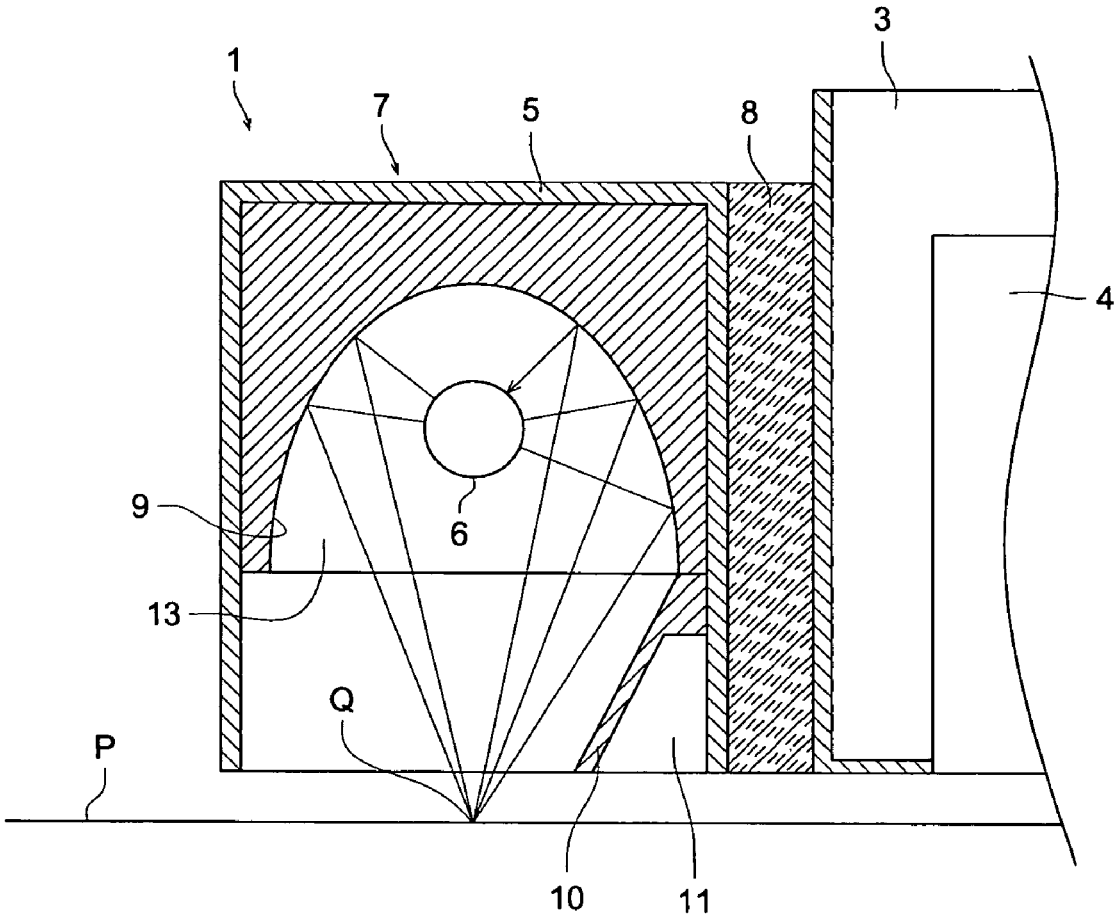
FIG. 2 is a schematic drawing of the first embodiment, showing the area adjacent to one of the ultraviolet ray emitting devices shown in FIG. 1.

FIG. 1 is a schematic drawing of a carriage and an ultraviolet ray emitting device of a serial method ink-jet recording apparatus of the present embodiment, and FIG. 2 is a schematic sectional view of the area adjacent to one of the ultraviolet ray emitting devices shown in FIG. 1.

Inkjet recording apparatus 1 incorporates plain platen 2 for supporting recording sheet P, on the rear surface of which the image is to be recorded, and upstream and downstream of platen 2 with respect to the conveyance direction (that is, the sub-scanning direction, or perpendicular to recording sheet P), conveyance rollers (which are not illustrated) for conveying recording sheet P are mounted. Above platen 2, a long carriage rail (which is also not illustrated) is disposed parallel to platen 2 and recording medium P, and perpendicular to the conveyance direction of recording medium P. Via the carriage rail, carriage 3 is supported and reciprocates along the carriage rail, in the main scanning direction (the direction of arrows Y shown in FIG. 1).

Carriage 3 is formed in a so-called book-holder style, composed of two plates, being a bottom plate and a rear plate, which are perpendicular to each other. On the bottom plate of carriage 3, recording heads 4 are mounted, having a plurality of nozzles (which are not illustrated) for jetting ink onto recording medium P supported by platen 2. Concerning the number of recording heads 4, four or eight heads are required corresponding to each color ink of yellow (Y), magenta (M), cyan (C) and black (B). A plurality of sub-ink tanks (which are not illustrated) are mounted on carriage 3 to store ink of each color to be supplied to recording head 4. Ink supplying tubes (which are not illustrated) are connected to each sub-tank to supply inks from ink tanks in which each color ink is stored (which are not illustrated).

Ultraviolet ray emitting device 7, composed of,

Light source box 5 (see FIG. 2) being a cuboid, whose bottom facing recording medium P is open, and light source 6, being a high-pressure mercury lamp, housed within light source box 5, is mounted on the above described two mutually perpendicular plates of carriage 3 with heat insulation material 8 between them. Domed first reflecting section 9 which reflects ultraviolet rays emitted from light source 6, is mounted within light source box 5 of ultraviolet ray emitting device 7, in such a way that first reflecting section 9 surrounds light source 6. In the present embodiment, it is structured in such a way that the ultraviolet rays emitted from light source 6, which is positioned at one of the focal points of first reflecting section 9, are reflected by first reflecting section 9, and concentrated onto the other focal point Q on recording medium P, directly below light source 6 (see FIG. 2).

At the recording head 4 side within the space of first reflecting section 9, second reflecting section 10 being a flat plate, is installed at an angle in such a manner that the closer second reflecting section 10 approaches recording medium P, the farther second reflecting section 10 is distanced from recording head 4. Further, second reflecting section 10 is formed in such a manner that the top, adjacent recording medium P does not block the concentrated rays of ultraviolet rays which are reflected by the first reflecting section 9 and directed to focal point Q on the recording medium P.

Ultraviolet ray trapping space 11, being an interior surface of a space, which exists adjacent to recording head 4 behind second reflecting section 10, is coated with an ultraviolet ray absorbing material. Said space is not subjected to light source 6, Since the interior space of domed first reflecting section 9 is divided into two spaces by second reflecting section 10, the one, being numeral 13, encloses light source 6, and the other, being ultraviolet ray trapping space 11, does not. Concerning the ultraviolet ray absorbing material, any material having a high absorbing ratio may be used, such as carbon black, an ultra-fine-grained titanium oxide, a zinc oxide, or ferric oxide ($\alpha$-$Fe_2O_3$, $Fe_3O_4$), all of which are minerals, as well as materials including a benzotriazole system compound, or an aromatic series compound, all of which are organic. Further for their surfaces, it is preferable that an alumite treatment being a metal oxide treatment, or plating, vacuum evaporation, or spattering, may be conducted. In this case, more preferable is that a semi-glossy painting treatment, shown in Color Code Book No. Bn-10, by Aggregate Corporation Japan Paint Manufacturers Association, is conducted on the metal, such as an iron and an aluminum.

Concerning the ultraviolet ray curable ink used in the present embodiment, radical polymerizable ink and cationic polymerizable ink, both including polymerizable monomers and radical polymerization compounds as a light-polymerization starting material, are preferably used. The radical polymerizable system ink has the characteristic that if the amount of ultraviolet rays radiated onto the ink do not exceed a threshold level, polymerization reaction does not start, and that the radical polymerization reaction is easily disturbed by ambient oxygen. On the other hand, the cationic polymerizable system ink has the characteristic that the polymerization reaction is not disturbed by ambient oxygen, and if ultraviolet rays are radiated onto the ink, polymerization reaction advances based on the amount of radiated ultraviolet rays, but which differs a radical polymerization system ink.

Next, the function of inkjet recording apparatus of the present invention will be described below.

In inkjet recording apparatus 1 of the present embodiment, while carriage 3 (see FIG. 1) reciprocates in the main scanning direction, along the carriage rail, ultraviolet curable inks of each color are jetted onto recording medium P, from the nozzles of recording head 4 mounted on carriage 3, after which, in order to harden the ink and fix the image on recording medium P, ultraviolet rays are emitted from ultraviolet ray emitting device 7 which has been positioned just above the deposited ink. In the present embodiment, as shown in FIG. 2, since first reflecting section 9 of ultraviolet ray emitting device 7 is formed to be a dome, being an elliptic mirror, by which the ultraviolet rays emitted from light source 6, positioned on one of the focal points of the elliptic mirror, are concentrated onto focal point Q on recording medium P, that is, concentrated and high energy ultraviolet rays are radiated onto the ink, immediately after the ink is deposited on the recording medium P.

Figure 3:
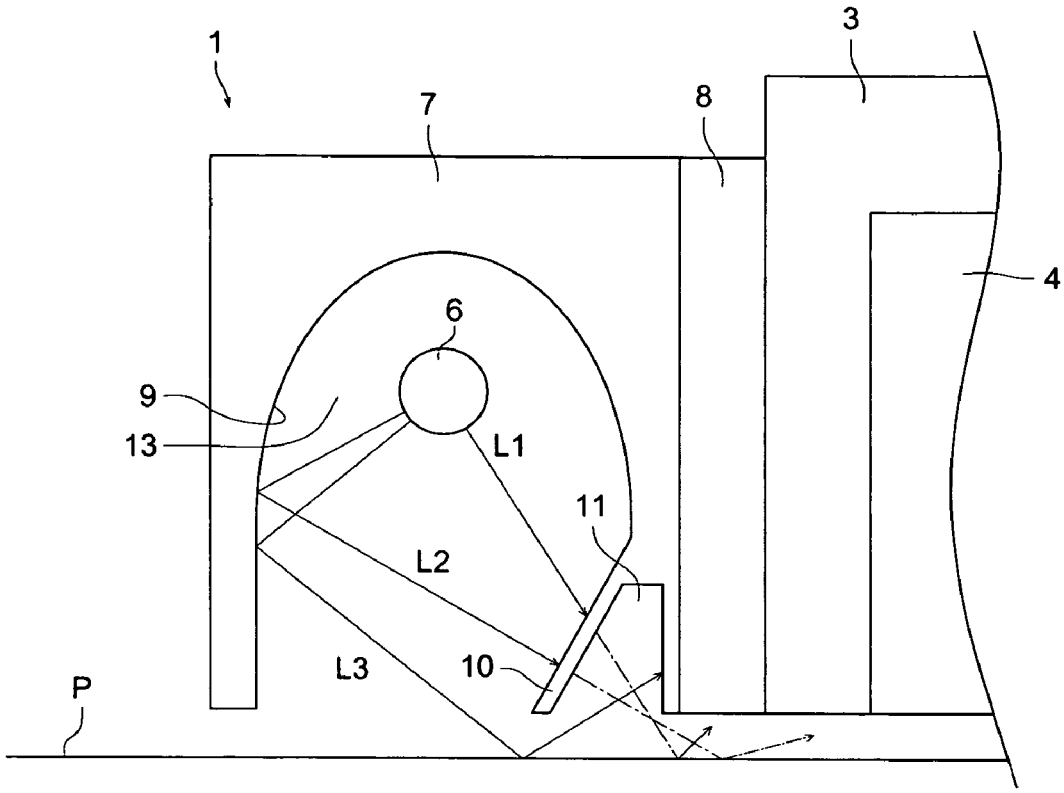
FIG. 3 is a schematic drawing of the first embodiment, explaining a second reflecting section by which stray ultraviolet rays approaching the nozzle surface area of a recording head are blocked.

Further, in the present embodiment, since second reflecting section 10 is slantingly attached to the recording head side, within the space of first reflecting section 9 of ultraviolet ray emitting device 7, the stray ultraviolet rays defused by the recording medium P are blocked by second reflecting section 10 so that the stray ultraviolet rays cannot leak toward recording head 4, and thus do not reach the nozzle surface area of recording head 4. FIG. 3 is a schematic drawing for explaining second reflecting section 10 by which the stray ultraviolet rays traveling toward the nozzle surface area of recording heads 4 are blocked.

In FIG. 3, if second reflecting section 10 does not exist, ultraviolet rays L1, which are emitted from light source 6, as well as ultraviolet rays L2, which are also emitted from light source 6, and reflected by first reflecting section 9, and traveling toward recording head 4, are reflected and diffused by recording medium P below carriage 3, as shown by dashed lines. As explained above, the maximum energy of the scattered light rays travels toward recording head 4, and reaches nozzle surface area 12 of recording head 4. However, in the present invention, since second reflecting section 10 is mounted at a slant adjacent to recording head 4, within the space of first reflecting section 9 of ultraviolet ray emitting device 7, ultraviolet rays L1 and L2 are blocked by second reflecting section 10. Therefore, ultraviolet rays cannot leak under carriage 3, and cannot reach the nozzle surface area 12 of recording head 4.

Further, in the present invention, as described above, ultraviolet ray trapping space 11 is formed behind second reflecting section 10, whereby, ultraviolet rays L3 emitted from light source 6 are reflected by first reflecting section 9 toward recording head 4, but after being reflected and diffused by recording medium P, reach ultraviolet ray trapping space 11, repeat the reflection in ultraviolet ray trapping space 11 to be reduced, and then ultraviolet rays L3 are absorbed by the treated surface of ultraviolet ray trapping space 11. Thus, via ultraviolet ray trapping space 11, which is formed behind second reflecting section 10, ultraviolet rays are blocked so that the ultraviolet rays cannot leak under carriage 3, nor reach nozzle surface area 12 of recording head 4. In the present embodiment, as described above, since the interior surfaces of ultraviolet ray trapping space 11 are coated with ultraviolet ray absorbing material, the ultraviolet ray absorbing material effectively absorb all stray ultraviolet rays which reach ultraviolet ray trapping space 11. Additionally, a semi-glossy paint treatment, shown in Color Code Book No. Bn-10, by Aggregate Corporation Japan Paint Manufacturers Association, is applied as a coating, that is, the ultraviolet ray absorbing ratio on the surface of ultraviolet ray trapping space 11 becomes greater than 99.9%, being extremely effective. Due to this, almost all of the stray ultraviolet rays which enter ultraviolet ray trapping space 11 are absorbed by ultraviolet ray trapping space 11, and very few stray ultraviolet rays reach nozzle surface area 12 of recording head 4.

According to inkjet recording apparatus of the present invention, as described above, since second reflecting section 10 is disposed near the recording head 4 side, below first reflecting section 9 of ultraviolet ray emitting device 7, leakage of stray ultraviolet rays toward nozzle surface area 12 is effectively blocked, and the ultraviolet rays are trapped by the ultraviolet ray trapping space 11 which is formed behind second reflecting section 10, and thereby, it is possible to prevent stray ultraviolet rays from reaching nozzle surface area 12 of recording head 4. Thereby, the ink near nozzle surface area 12 of the recording head 4 is prevented from absorbing the ultraviolet rays, and as a result, it prevents an increase in ink viscosity and unintended hardening. Due to this, stable ink jetting from recording head 4 is possible over an extended period of time, and image formation at high droplet depositing accuracy can be achieved. Additionally, since second reflecting section 10 is disposed adjacent to and under first reflecting section 9 of ultraviolet ray emitting device 7, there is no need to add another ultraviolet ray trapping space, by simply increasing the distance between recording head 4 and ultraviolet ray emitting device 7. Whereby, specifically, in serial method inkjet recording apparatus 1 of the present embodiment, downsizing of carriage 3 can be realized.

Still further, as previously cited, cationic polymerizable system ink has the characteristic that the polymerization reaction is based on the amount of radiated ultraviolet rays, and the reactivity is not eliminated over a time interval, and the reactivity remains in said ink. Therefore, in the case of cationic polymerizable ink, when the ultraviolet rays reach nozzle surface area 12 of recording head 4, even when the current amount of ultraviolet rays is relatively small, the reaction is based on the total amount of ultraviolet rays, whereby the ink increases in viscosity and is hardened. However, as cited above, in the present invention, since second reflecting section 10 is disposed under first reflecting section 9 of ultraviolet ray emitting device 7 and adjacent to recording head 4, the ink is prevented from increasing in viscosity, and also from hardening, even when cationic polymerizable ink is used.

In the present embodiment, second reflecting section 10 is formed as a flat plate, but it is also possible to form it as a curved surface, as long as the curved surface can achieve the above cited effects. Further it is also possible to install second reflecting section 10 at a position higher than the position shown in FIG. 2, as long as second reflecting section 10 does not disturb the concentrated ultraviolet rays directed toward focal point Q on recording medium P. Additionally, it is also possible to increase the angle of second reflecting section 10 within light source box 5.

Still further, concerning the ultraviolet ray absorbing material with which ultraviolet ray trapping space 11 formed by second reflecting section 10 is coated, all the interior surfaces are coated with said ultraviolet ray absorbing material, but it is also possible to coat only the rear surface of second reflecting section 10, which is a part of the total interior surface of ultraviolet ray trapping space 11. Additionally, if the interior surface of light source box 5 of ultraviolet ray emitting device 7 is coated with the ultraviolet ray absorbing material, the leakage of the ultraviolet rays toward recording head 4 can be effectively blocked.

A high pressure mercury lamp is employed on light source 6 in the present embodiment, but a metal halide lamp, a black light, a cold cathode lamp, or a LED (light emitting diode) may also be employed. Further, light source 6 is a single light source in FIG. 1, but it is possible to structure a way in that the light rays emitted from a plurality of light sources are concentrated by a lens.

In the present embodiment, it is stated that the ultraviolet rays emitted from light source 6 are reflected by first reflecting section 9, and concentrated at focal point Q just below light source 6 (see FIG. 2). That is, the structure, including the concentrated ultraviolet rays, can preferably control loss of the ultraviolet rays, emitted from ultraviolet emitting device 7, even when second reflecting section 10 is employed.

[The Second Embodiment]

Figure 4:
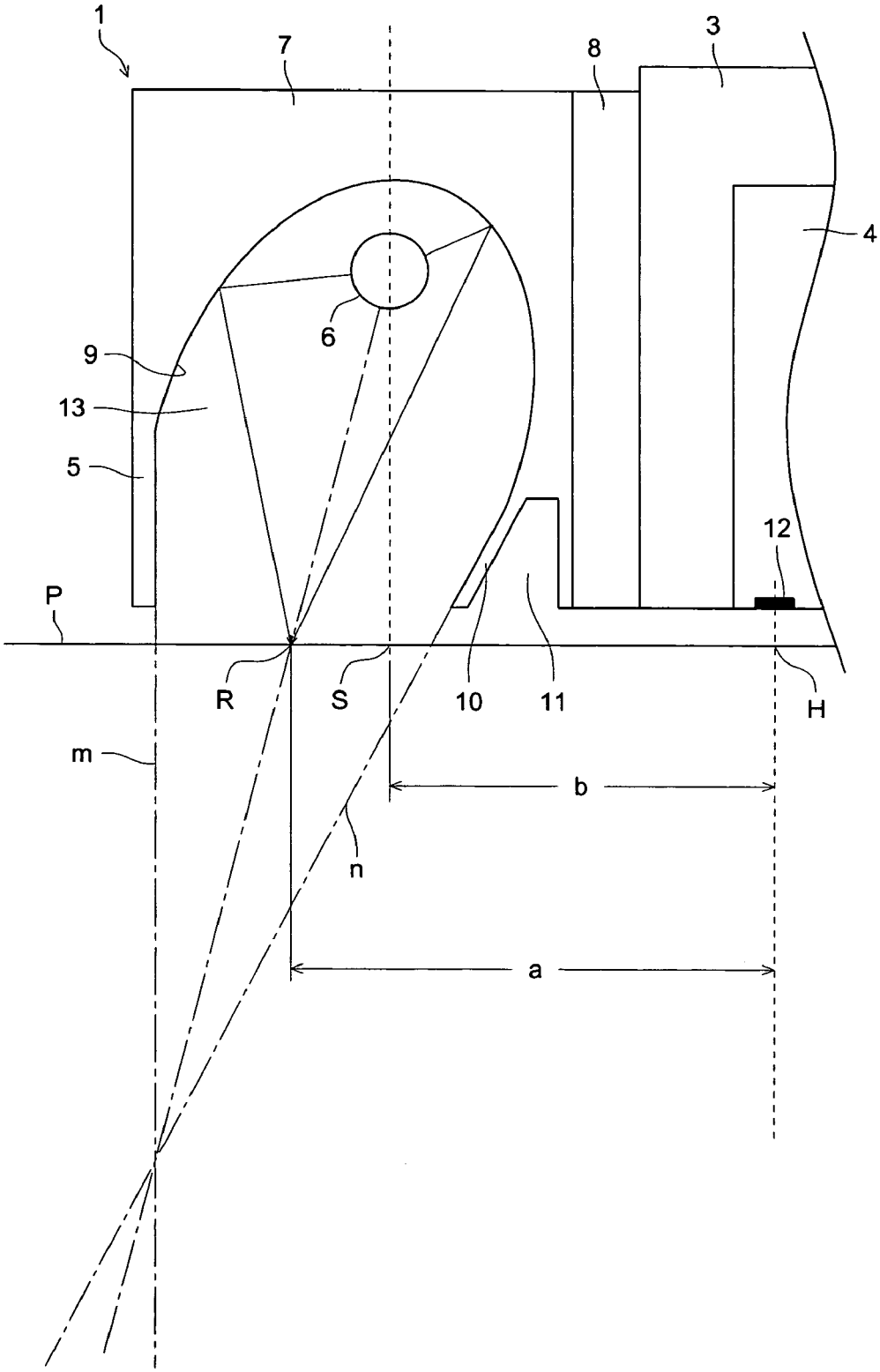
FIG. 4 is a schematic drawing of the second embodiment, showing the area adjacent to the ultraviolet ray emitting device, wherein distance "a" is greater than distance "b".

FIG. 4 is a schematic drawing showing the vicinity of an ultraviolet ray emitting device, featuring first reflecting section 9, being an elliptic mirror, slightly tilted with light source box 5 of ultraviolet ray emitting device 7, and second reflecting section 10. In this embodiment, distance "a" is between focal point R of ultraviolet rays reflected by first reflecting section 9 onto the recording medium P and position H of the ultraviolet ray curable ink deposited onto the recording medium, and distance "b" is between foot S which is dropped perpendicularly from light source 6 to recording medium P and position H of the ultraviolet ray curable ink deposited onto the recording medium, wherein distance "a" is greater than distance "b". By this structure of first reflecting section 9, the concentrated light rays are diffused on recording medium P away from recording head 4, resulting in reduction of leakage of the stray ultraviolet rays toward recording head 4. Desired function and effect of above described second reflecting section 10 are also realized.

In this case, in FIG. 4, line m is a prolongation line of the interior surface of box 5 of ultraviolet ray emitting device 7, and line n is a prolongation line of the surface of second reflecting section 10 facing light source 6, and point T is an intersecting point of line m and line n. If first reflecting section 9 is formed in such a way that focal point R on recording medium P is located on a line joining point T and light source 6, leakage of the ultraviolet rays, emitted from light source 6 toward recording head 4, is more positively blocked.

It is also possible to form a structure wherein ultraviolet rays reflected by first reflecting section 9 are parallel rays. First reflecting section 9 has a parabolic reflecting surface. As cited above, second reflecting section 10 is tilted in reference to the recording head 4 side, within the space of first reflecting section 9, and thereby, parallel ultraviolet rays are reflected by second reflecting section 10 in such a way that the ultraviolet rays are directed away from nozzle surface area 12 (see FIG. 3) of recording head 4. Additionally, the ultraviolet rays are trapped within ultraviolet ray trapping space 11. That is, by employing second reflecting section 10, arrival of the ultraviolet rays at nozzle surface area 12 of recording head 4 is effectively prevented. Since the ultraviolet rays are efficiently trapped, the effect which is the same as the effect of above described invention is also realized.

The above description in the case of inkjet recording apparatus 1 of the present invention is the serial method, however second reflecting section 10, being characteristic to the present invention, can effectively block the leakage of stray ultraviolet rays toward recording head 4, in which inkjet recording apparatus 1 of the present invention is the line method. Further, variations described in the case of the serial method inkjet recording apparatus can be also used for the case of the line method inkjet recording apparatus. Still further, since second reflecting section 10 has been disposed adjacent to and below the first reflecting section of the ultraviolet ray emitting device, without adding a new ultraviolet ray trapping space simply by increasing the distance between the recording head and the ultraviolet ray emitting device, downsizing of the overall apparatus becomes possible.

[The Third Embodiment]

Figure 5:
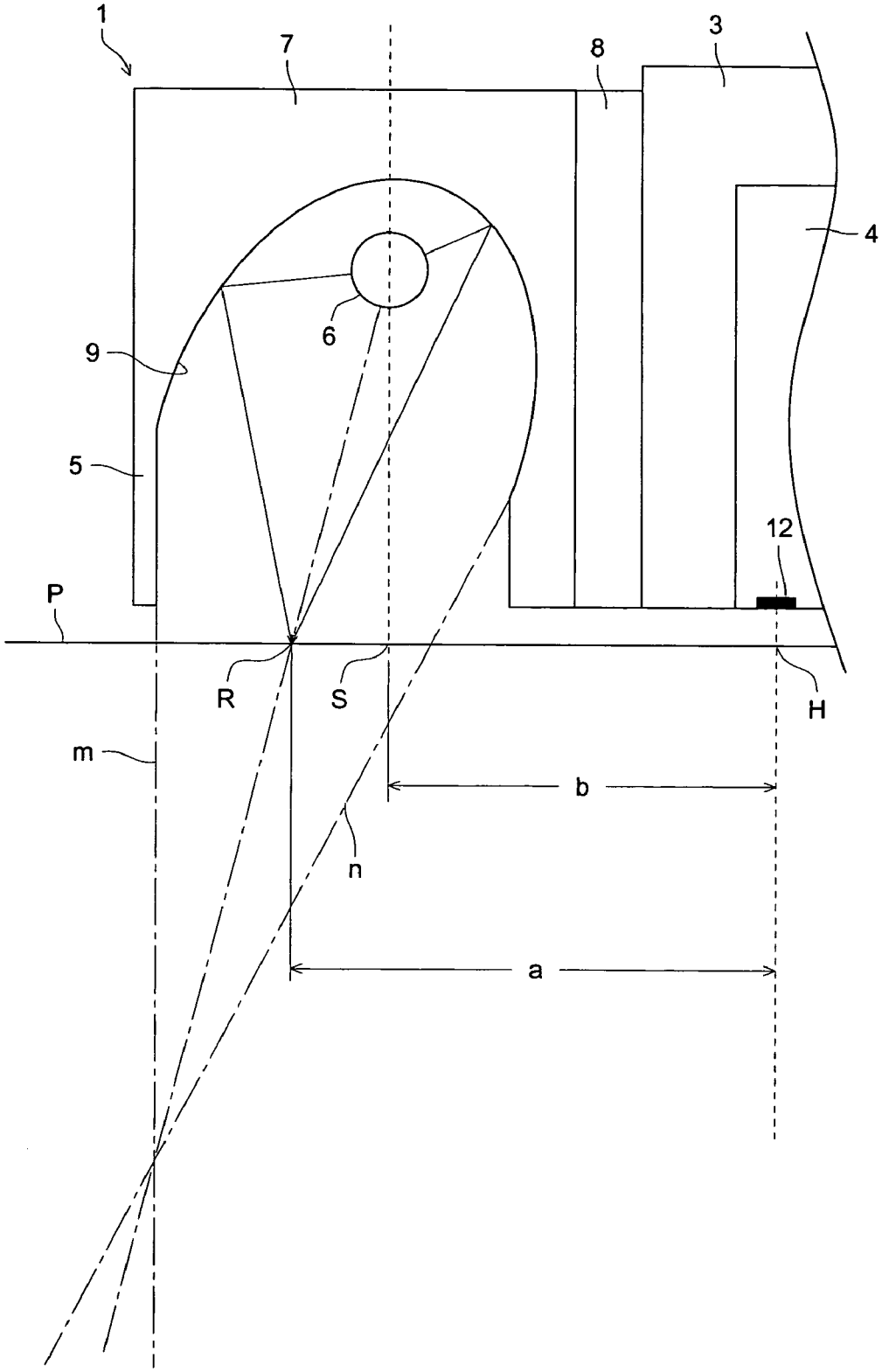
FIG. 5 is a schematic drawing of the third embodiment, wherein distance "a" is greater than distance "b".

In FIG. 5, the first reflecting section 9, having an elliptic reflecting surface, is inclined from the recording head, while light source 6 is positioned in a first focal point of the first reflecting section. In this embodiment, the second reflecting section is not employed, and thereby trapping space does not exist. The ultraviolet rays are emitted from light source 6, and concentrated at point R, being a second focal point, by the first reflecting section 9, then the ultraviolet rays are absorbed by the ink. However, ultraviolet rays defused on the recording medium do not approach the ultraviolet ray curable inks in nozzle surface 12. Because distance "a" is greater than distance "b", and further, the interior surface of light source box 5 is covered with the ultraviolet ray absorbing material. Accordingly, the effect which is the same as the effect of above described invention is also realized.

What is claimed is:

1. An inkjet recording apparatus, comprising:

a recording head for jetting ultraviolet ray curable ink onto a recording medium, an ultraviolet ray emitting device, for emitting ultraviolet rays onto the ultraviolet ray curable ink deposited on the recording medium, and for hardening and fixing the ultraviolet ray curable ink, including;

a light source which emits ultraviolet rays, a first reflecting section for reflecting the ultraviolet rays emitted from the light source, onto the recording medium, and a second reflecting section which is installed within the first reflecting section at an angle in such a manner that the closer the second reflecting section is to the recording medium, the farther the second reflecting section is distanced from the recording head, for preventing the ultraviolet rays from approaching the ultraviolet ray curable ink in the recording head, and behind the second reflecting section, a space for trapping stray ultraviolet rays diffused from the recording medium is formed.

2. The inkjet recording apparatus described in claim 1, wherein the first reflecting section reflects the ultraviolet rays emitted from the light source, and the ultraviolet rays are concentrated onto the recording medium.

3. The inkjet recording apparatus described in claim 2 wherein distance "a", which is between a focal point of the ultraviolet rays reflected by the first reflecting section onto the recording medium and a position of the ultraviolet ray curable ink deposited onto the recording medium, is greater than distance "b", which is between a foot which is dropped perpendicularly from the light source to the recording medium and the position of the ultraviolet ray curable ink deposited onto the recording medium.

4. The inkjet recording apparatus described in claim 2, wherein the second reflecting section is formed in such a manner that a top, adjacent to the recording medium, of the second reflecting section does not block the ultraviolet rays which are reflected by the first reflecting section and directed to a focal point on the recording medium.

5. The inkjet recording apparatus described in claim 1, wherein the first reflecting section reflects the ultraviolet rays radiated from the light source, to be parallel to each other, and said parallel rays are radiated onto the recording medium.

6. The inkjet recording apparatus described in claim 1, wherein an ultraviolet ray absorbing material for absorbing the ultraviolet rays, is coated on interior surfaces of the space for trapping the diffused ultraviolet rays.

7. The inkjet recording apparatus described in claim 1, wherein the ultraviolet ray absorbing material is coated on a rear surface of the second reflecting section.

8. The inkjet recording apparatus described in claim 1, further comprising a light source box for including the light source, the first reflecting section, and the second reflecting section, wherein the ultraviolet ray absorbing material is coated on an interior surface of the light source box.

9. The inkjet recording apparatus described in claim 1, wherein the light source is a single light source.

10. The inkjet recording apparatus described in claim 9, wherein the light source is any one of a high-pressure mercury lamp, a metal halide lamp, a black light, a cold cathode lamp, and an LED.

11. The inkjet recording apparatus described in claim 1, wherein the recording head employs a serial method or a line method.

12. The inkjet recording apparatus described in claim 1, wherein the ultraviolet ray curable ink is a cation polymerizable system ink.

* * * * *